United States Patent [19]

Ryder

[11] Patent Number: 4,605,135

[45] Date of Patent: Aug. 12, 1986

[54] SCREW-TOPPED CONTAINERS HAVING SAFETY MEANS

[75] Inventor: Geoffrey A. Ryder, 18 Meadow Green, Welwyn Garden City, Hertfordshire, England

[73] Assignees: Trevor G. Evans; Geoffrey A. Ryder; Lyn T. Evans, all of Hertfordshire, England

[21] Appl. No.: 791,069

[22] Filed: Oct. 24, 1985

[30] Foreign Application Priority Data

Nov. 5, 1984 [GB] United Kingdom ..... 8427911

[51] Int. Cl.[4] ..... B65D 55/02

[52] U.S. Cl. ..... 215/220; 215/211; 215/217; 222/153

[58] Field of Search ..... 215/211, 220, 217; 222/153

[56] References Cited

U.S. PATENT DOCUMENTS 4,004,704 1/1977 Hilaire ..... 215/220

4,358,031 11/1982 Lohrman ..... 215/217

FOREIGN PATENT DOCUMENTS 1240431 7/1971 United Kingdom .

*Primary Examiner*—George T. Hall

*Attorney, Agent, or Firm*—Robbins & Laramie

[57] ABSTRACT

A bottle with a neck (1) has a child-resistant screw closure cap (13). In order to make the cap (13) child-resistant, the neck (1) is fitted with a collar (7) of U-shaped cross-section. The collar (7) is retained on the neck (1) by engagement of pawls (11) inside a portion (8) of the collar under a retaining ring (2) on the neck (1). The cap (13) is screwed onto the part (8) of the collar and to allow this to be done, the collar (7) is prevented from rotating on the neck (1) by engagement of the pawls (11) with ratchet teeth (4) on the outside of the neck (1). The pawls (11) and the ratchet teeth (4) are so shaped that if an attempt is made to unscrew the cap (13) merely by turning it in a counter-clockwise direction as seen from above, the pawls (11) ride over the ratchet teeth (4) so that the collar (7) is lifted on the neck (1) and is free to rotate. To enable the cap (13) to be unscrewed, the cap must be pressed downwards while it is rotated in a counter-clockwise direction to hold the pawls (11) in engagement with the ratchet teeth (4) and thus prevent the collar (7) from turning on the neck (1).

9 Claims, 5 Drawing Figures

SCREW-TOPPED CONTAINERS HAVING SAFETY MEANS

This invention relates to bottles or other screw-topped containers fitted with safety caps, which are commonly known as child-resistant, or sometimes child-proof, caps. These caps are constructed in such a way that they can easily be screwed onto the container, but can only be unscrewed from the container by the application of an unscrewing torque combined with some other force of such a nature that the combination of torque and force cannot, or cannot at all easily, be applied by a small child.

The invention is specifically concerned with a container having a child-resistant cap and which is of the kind comprising a projecting retaining ring formed integrally with the container around the outside of the top opening of the container, a collar, which has an external screw thread, rotatably mounted around the opening and retained in position by the retaining ring, and a closure cap which is screwed onto the collar to close the container, the collar and the container having inter-engaging parts, which co-operate with each other in such a way that as the cap is turned on the collar in one direction, the collar is prevented from rotating on the container so that the cap is screwed onto the collar, and as the cap is turned in a reverse direction, the collar turns on the container to prevent the cap from being unscrewed, but the inter-engaging parts being arranged to prevent rotation of the collar in the reverse direction to allow the cap to be unscrewed by the application to the cap of an additional force in a direction different from that necessary to unscrew the cap.

An example of a container of the kind just described is disclosed in No. GB-B-1240431. In this example, the part of the container on which the collar is mounted is non-circular and the inter-engaging parts consist of a radial projection on the container and a slot in the collar. The projection is caused to engage in the slot to prevent reverse rotation of the collar by exerting an inward radial force on the cap in the vicinity of the slot while the slot is aligned with the projection.

This arrangement has a number of disadvantages. Firstly, the container and collar must be made of material of a particular flexibility and resilience to enable the necessary distortion to take place to cause the projection to engage in the slot. A precise selection of materials to provide this flexibility and resilience of the container and collar adds to their cost of production. It also makes it impossible to apply the arrangement to glass bottles. Secondly, the slot in the collar and the projection on the container must be exactly aligned with each other before unscrewing of the cap is possible and this alignment may be difficult to achieve. Thirdly, the direction of the inward radial force relative to the cap alters continuously as the cap is turned on the collar and it may be so difficult to maintain the force in the correct direction that the cap becomes resistant to opening not only by children, but by adults as well. Indeed, opening may be so difficult that it is beyond the capabilities of adults who lack manual dexterity.

The aim of the present invention is to provide a container with a child-resistant cap of the kind described above which can be manufactured quite simply, the container being of plastics material, metal and plastics combination or glass, and which has a very effective resistance to opening by small children whilst being readily openable by adults.

To this end, according to this invention, a child-resistant container of the kind described above is characterised in that the collar is U-shaped in radial section and comprises a portion which fits around the opening of the container and over the retaining ring, a portion which extends over the edge of the container around the opening, and a tubular plug portion which fits within the opening and seals against the inside of the part of the container surrounding the opening; the cap forms a seal against the collar when it is fully screwed on to the collar; and the inter-engaging parts comprise a series of ratchet teeth formed integrally with the container spaced apart from each other around the top opening and spaced from the retaining ring on the side thereof remote from the top opening, means on the collar which co-operate with the retaining ring to hold the collar on the container and pawls on the collar which co-operate with the ratchet teeth to allow the cap to be screwed onto the collar, but prevent the collar from turning in a direction to allow the cap to be unscrewed only when a sufficient axial force, which forms the additional force, is applied to the cap to push the cap towards the top opening and hold the pawls in engagement with the teeth.

In order to perform the function described above, the ratchet teeth and the pawls are shaped so that they lock together in the screwing-on direction, but allow the pawls to ride over the teeth in the unscrewing direction unless the axial force is applied to the cap and thence to the collar.

With the construction in accordance with the invention, the collar, and with it the cap, are necessarily axially movable to a limited extent on the container even when the cap is screwed tightly onto the collar and it is for this reason that it is necessary to seal the container by forming a seal between the cap and a portion of the collar and forming a second seal between the tubular plug portion of the collar and the inside surface of the container surrounding the top opening. The length of the plug portion is such that the sealing fit is maintained in all axial positions of the collar on the container.

The container may be of glass or other rigid material, but it is preferably moulded out of thermo-plastics material as this material can be more accurately moulded with the necessary ring and ratchet teeth.

Especially if the container is of glass or other rigid material, the collar is preferably of resilient thermoplastic plastics material so that it can be force fitted over the retaining ring on the container.

The cap may also be of metal, but is preferably moulded out of plastics material. The engagement of the cap on the collar must provide sufficient friction to ensure that when the cap is fully screwed onto the collar, the friction between the container and the collar is not sufficient to allow the cap to be unscrewed from the collar without the application of an adequate axial force on the cap to hold the pawls and the teeth in engagement with each other.

The pawls on the collar may also form the means which co-operate with the retaining ring to hold the collar on the container. Alternatively, however, the collar may be provided with its own retaining ring or a series of protrusions which co-operate with the retaining ring on the container.

In one form of container in accordance with the invention, the cap is conventional and has an imperforate top and, when screwed fully on to the collar forms a seal with the portion of the collar which extends over the edge of the container. For this purpose the cap may be provided with a conventional sealing liner inside its top.

In another form of container which is intended for holding and dispensing liquids, the cap is held captive on the collar and has a central opening in its top. This opening is closed and sealed by a plug portion formed integrally within the collar when the cap is screwed fully on to the collar, but when the cap is unscrewed, the plug moves out of the opening and leaves a passage from the inside of the bottle around the plug and thence through the opening in the cap.

Two examples of screw-topped bottles in accordance with the invention will now be described with reference to the accompanying drawings in which.

Figure 1:
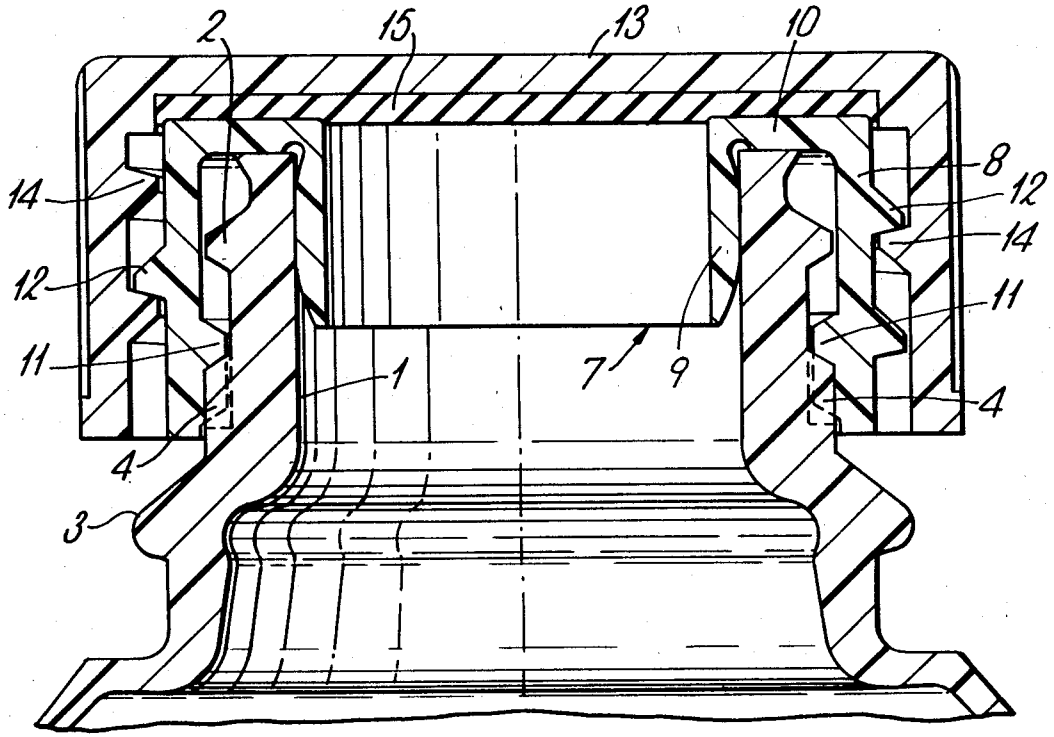
FIG. 1 is a diametric section through the neck of the first example of the bottle and through the adjacent parts of the collar and cap with the cap fully screwed onto the collar and the collar pushed fully onto the neck of the bottle.
Figure 4:
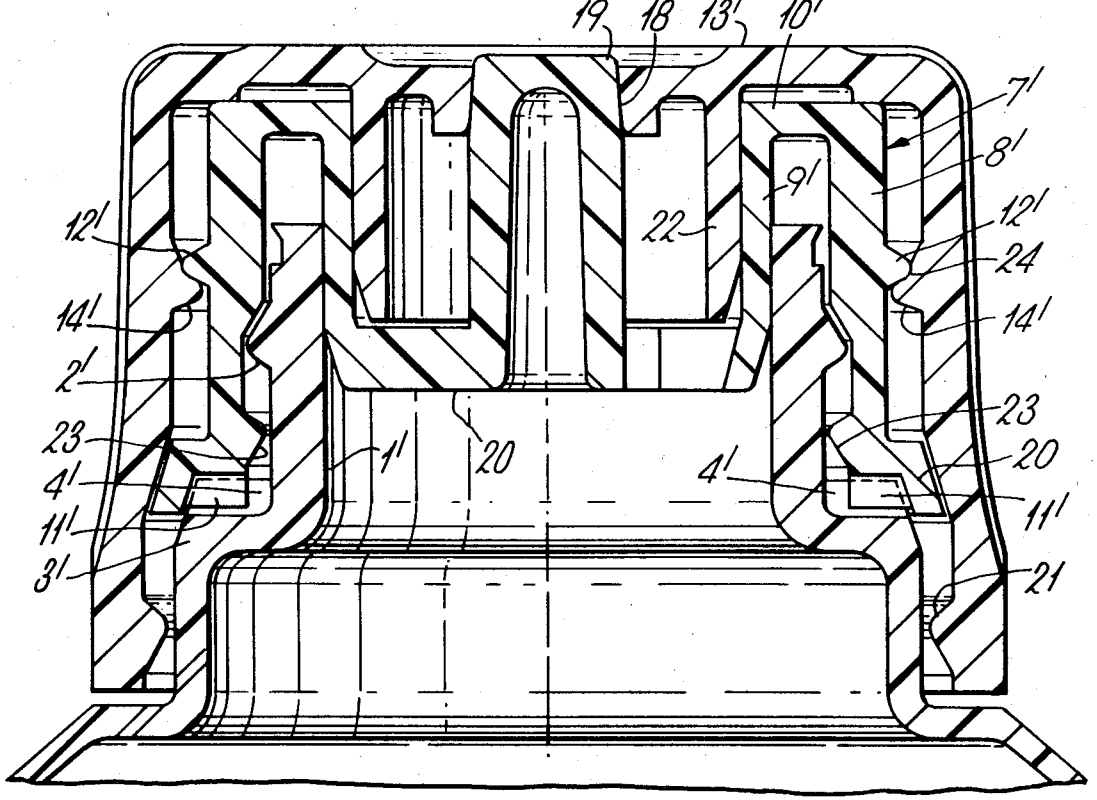
Figure 5:
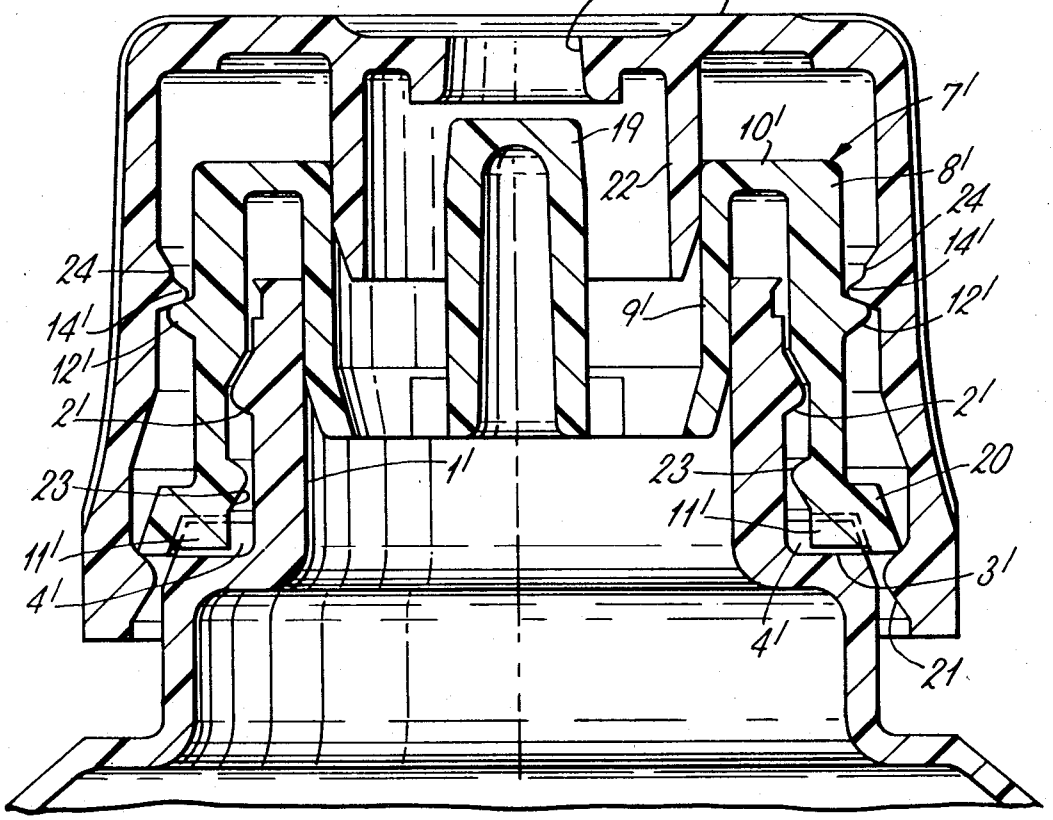

FIG. 4 is a diametric section similar to FIG. 1, but through the neck of the second example of the bottle and through the adjacent parts of the collar and cap with the cap fully screwed onto the collar and the collar pushed fully onto the neck of the bottle; and, FIG. 5 is a diametric section of the second example similar to FIG. 4, but showing the cap, which is captive on the collar, unscrewed from the collar to provide a passage through a central opening in the top of the cap.

In the first example, a bottle, which is blow-moulded out of thermoplastics material has a neck 1 with a retaining ring 2 and a shoulder 3 moulded integrally with it. As shown most clearly in FIG. 3, immediately above the shoulder 3, the neck 1 is provided with four ratchet teeth 5, which are also integrally moulded with the neck and are equally-angularly spaced at 90° intervals around the neck. Each of the ratchet teeth 4 has a sharp acutely-angled face 5 and a rounded obtusely-angled face 6. A collar 7 has a portion 8 which extends around the outside of the neck 1, a tubular plug portion 9 which is a push fit within the neck 1 and a connecting portion 10 which fits over the top edge of the neck 1. The portion 8 is provided on its inside face with a series of pawls 11 which are equally-angularly spaced around it. There are preferably a minimum of four pawls 11 to ensure that the portion 8 remains centred around the neck 1, but in this example there are eight of the pawls 11.

The collar 7 is retained on the neck 1 by the engagement of pawls 11 under the retaining ring 2. The collar is fitted in position by forcing it over the upper end of the neck 1 so that the pawls 11 snap over the ring 2. This force fitting is possible owing to the resilience of the plastics material of which the neck 1 and the collar 7 are made. It is possible to fit a collar in the same way to the neck of a glass bottle provided that the collar has sufficient resilience.

Figure 2:
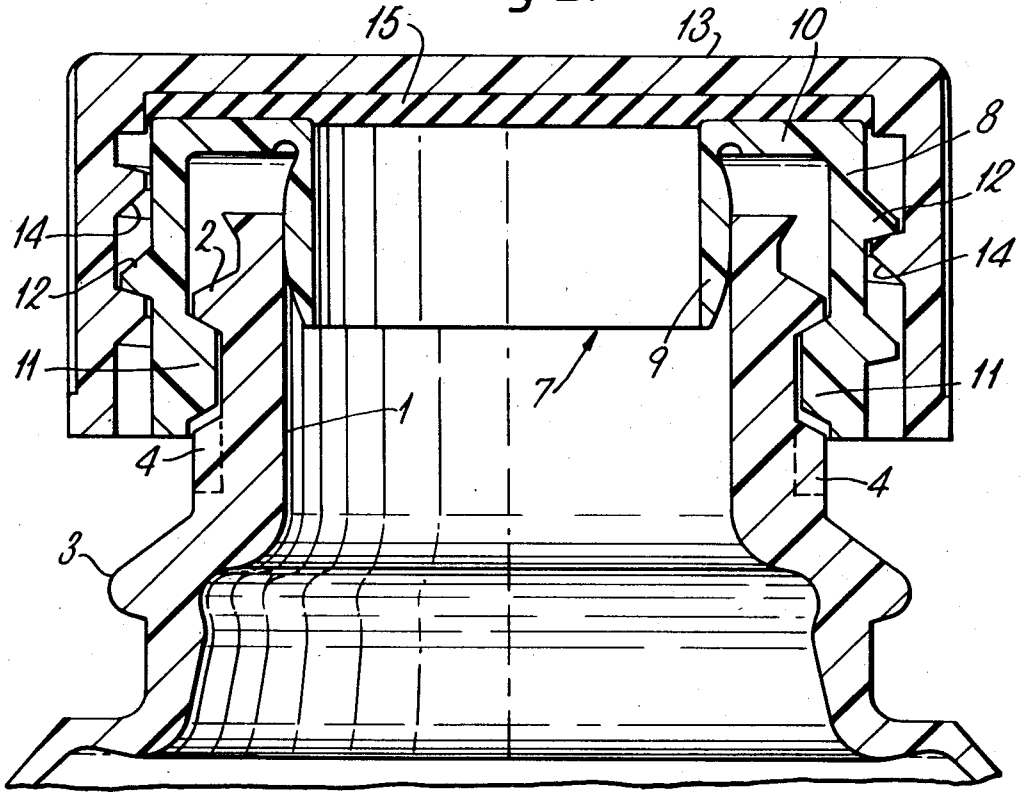
FIG. 2 is a diametric section similar to FIG. 1, but showing the collar raised on the neck of the bottle to allow pawls on the collar to ride over teeth on the neck of the bottle and allow the collar to turn on the neck.

The collar has an external screw thread 12 on the portion 8 and a cap 13 having an internal screw thread 14 is screwed onto the portion 8 of the collar 7. When the cap 13 is screwed fully onto the collar 7 as shown in FIGS. 1 and 2, a liner 15 within the cap engages with the portion 10 of the collar and forms a seal. Even when the cap is fully screwed on in this way, however, the cap 1 together with the collar 7 can be moved upwards and downwards on the neck 1 through a limited distance between the position shown in FIG. 1 in which the pawls 11 engage with the ratchet teeth 4 and the position shown in FIG. 2 in which the pawls 11 engage with the underside of the retaining ring 2 and are clear of the ratchet teeth 4. Even when the cap 13 and the collar 7 are in the raised position shown in FIG. 2, however, the sealing of the bottle is maintained by the engagement of the plug portion 9 of the collar within the neck of the bottle and by the seal between the liner 15 and the portion 10 of the collar.

In order to screw the cap 13 onto the collar 7, the cap is pushed downwards while it is being turned on the collar 7 so that the engagement of the screw thread 14 on the inside of the cap with the upper flank of the screw thread 12 on the collar pushes the collar downwards into the position shown in FIG. 1. This brings flat faces 16 on the pawls 11 into engagement with the faces 5 of the ratchet teeth 4. The shape of the faces 5 and 16 is such that this engagement is maintained as the cap 13 is turned in a clockwise direction as seen from above in FIG. 1 and accordingly the collar 7 is prevented from turning on the neck 1 and the cap 13 can be screwed tightly onto the collar.

If, after the cap 13 has been screwed tightly onto the collar 7 as just described, an attempt is made to unscrew the cap 13 merely by turning it in a counter-clockwise direction as seen from above in FIG. 1, the collar 7 will turn on the neck 1 until rounded faces 17 of the pawls 11 engage with the rounded obtusely-angled faces 6 on the ratchet teeth 4. This causes the pawls 11 to ride upwards on the teeth 4 thus raising the collar 7 on the neck 1 into the position shown in FIG. 2. The collar 7 can then rotate freely on the neck 1 and therefore the cap 13 cannot be unscrewed from the collar.

To enable unscrewing to take place, the cap 13 must be pushed downwards with sufficient force to overcome the tendency for the pawls 11 to ride up the faces 6 of the ratchet teeth while a torque, which is counter-clockwise in direction as seen from above in FIG. 1 is applied to the cap to unscrew it. Only by the application of this downward axial force together with the necessary counter-clockwise torque can unscrewing of the cap be effected. The shape of the curved faces 17 of the pawls 11 and of the faces 6 of the teeth 4 are made such that the magnitude of the required axial force on the cap 13 to enable it to be unscrewed is greater than can be exerted by a small child. A small child cannot therefore unscrew the cap once it has been reasonably tightly screwed up. Apart from the force necessary to enable the cap to be unscrewed, it is generally beyond the understanding of a small child to appreciate that to enable the cap to be unscrewed it must be pressed downwards at the same time as it is turned counter-clockwise. There is therefore a mental difficulty as well as a physical difficulty involved in unscrewing the cap.

Figure 3:
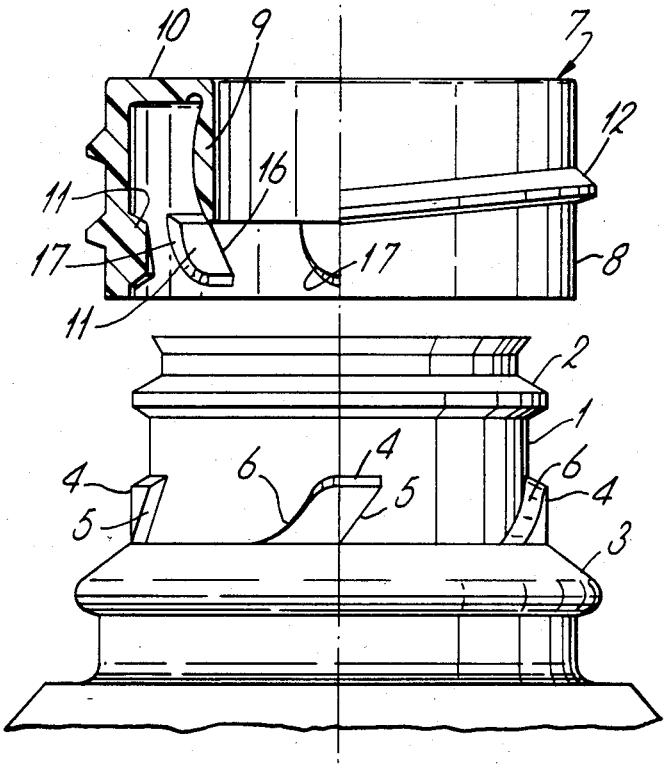
FIG. 3 is an exploded side elevation to a smaller scale of the neck of the first example of the bottle and of the collar, which is shown partly in radial section to illustrate internal details.

The second example shown in FIGS. 4 and 5 of the drawings is similar in its principles of construction to that of the first example shown in FIGS. 1 to 3 and corresponding parts have been given the same reference numerals but primed.

The main differences between the second example and the first example shown in FIGS. 1 to 3 are firstly that the cap 13' has in its top a central opening 18, which is shown most clearly in FIG. 5. The collar 7' is provided with an integrally moulded central plug portion 19 which is connected to the bottom of the portion 9' by radial webs 20. When the cap 13' is screwed fully onto the collar 7' as shown in FIG. 4, the plug portion 19 fits in and seals the opening 18.

Secondly, the portion 8' of the collar is provided at its bottom with a radially projecting circumferential skirt 20 and the inside of the bottom of the cap 13' is provided with a projecting ring 21. When the cap 13' and the collar 7' are assembled, the ring 21 is snapped over the skirt 20, but when the cap 13' is unscrewed from the collar 7' as shown in FIG. 5, the ring 21 engages with the skirt 20 and holds the cap 13' captive on the collar. When the cap is unscrewed in this way, which is brought about by pressing the cap 13' downwards and turning it in a counter-clockwise direction as seen from above in FIGS. 4 and 5, the plug 19 is moved out of the opening 18 so that there is an outlet passage from the bottle through the neck 1' between the portion 9' and the plug 19 of the collar 7' and thence through the opening 18. Since the bottle is made of flexible and resilient thermoplastic plastics material, squeezing of the bottle enables the liquid contents of the bottle to be squirted out of the opening 18.

In this example, instead of providing a liner inside the top of the cap 13', the cap is provided with a tubular portion 22 which is a push fit within and seals against the inside of the portion 9' of the collar 7'.

Further differences between the second example and the first example are that in the second example the pawls 11' are provided within the skirt 20 and do not therefore protrude within the bore of the portion 8' of the collar. In order to retain the collar 7' on the neck 1', the portion 8' of the collar is provided with an integrally moulded internal ring 23. The ring 23 is a snap fit over the retaining ring 2' when the collar 7' is fitted to the neck 1' in the same way as the pawls 11 snap over the ring 2 in the first example.

When the cap 13' is screwed fully onto the collar 7' as shown in FIG. 4, the cap 13' and the collar 7' can be raised on the neck 1' to free the pawls 11' from the ratchet teeth 4' so that the cap and collar are freely rotatable on the neck 1'. When the cap 13' is unscrewed from the collar 7' by the application of an axial force to hold the pawls 11' and the teeth 4' in engagement with each other and by turning the cap 13' counter-clockwise, the plug 13 is removed from the opening 18 as already explained, but a seal is maintained between the tubular part 22 of the cap 13' and the inside of the portion 9' of the collar so that the liquid in the bottle cannot leak into the space between the cap and the outside of the portion 8' of the collar and thence leak around the screw threads 12' and 14'.

In this example, the screw thread 14' within the cap 13' has a step 24 in its flank to produce a self-centring effect of the cap 13' on the collar 7' as the cap is screwed tightly onto the collar and the tip of the thread 12' rides up onto the step 24. The form of the screw thread 14' is as described in our British Pat. No. GB-B-1 172 608.

I claim:

1. A container in combination with child-resistant closure means, said container comprising means defining a top opening thereof and a projecting retaining ring formed integrally with said container and extending around the outside of said top opening, and said closure means comprising a collar, an external screw-thread on said collar, means rotatably mounting said collar around said opening, said collar being retained in position around said opening by said retaining ring, and a closure cap screwable onto said collar to close said top opening, said collar and said container including inter-engaging parts which cooperate with each other whereby as said cap is turned on said collar in one direction, said collar is prevented from rotating on said container to allow said cap to be screwed onto said collar and as said cap is turned in a reverse direction, said collar turns on said container to prevent said cap from being unscrewed from said collar, but said inter-engaging parts being arranged to prevent said rotation of said collar in said reverse direction to allow unscrewing of said cap from said collar by the application to said cap of an additional force, wherein said collar is U-shaped in radial section and comprises a first portion which fits around said top opening of said container and over said retaining ring, a second portion which extends over an edge portion of said container around said top opening, and a third tubular plug portion which fits within said top opening and seals against an inside surface of said container surrounding said top opening, means forming a seal between said cap and said collar when said cap is fully screwed onto said collar; wherein said inter-engaging parts comprise a series of ratchet teeth formed integrally with said container, said ratchet teeth being spaced apart from each other around said top opening and being spaced from said retaining ring on the side thereof remote from said top opening; wherein means is provided on said collar cooperating with said retaining ring whereby said retaining ring retains said collar in position and pawls are provided on said collar, said pawls cooperating with said ratchet teeth to allow said cap to be screwed onto said collar but to prevent said collar from turning on said container to allow said cap to be unscrewed from said collar only when a sufficient axial force, which forms said additional force, is applied to said cap to push said cap towards said top opening and hold said pawls in engagement with said teeth.

2. A container as claimed in claim 1, in which said pawls of said collar also form said means which cooperates with said retaining ring.

3. A container as claimed in claim 1, in which said cap includes an imperforate top and said means forming a seal between said cap and said collar forms a seal between said imperforate top and said second portion of said collar.

4. A container as claimed in claim 3, in which said means forming a seal between said cap and said collar is a sealing liner inside said imperforate top.

5. A container as claimed in claim 1, in which said cap includes a top portion, and further comprising means holding said cap captive on said collar, means defining a central opening in said top of said cap, and plug means formed integrally with said collar, said opening in said top of said cap being closed and sealed by said plug means when said cap is screwed fully onto said collar, but when said cap is unscrewed from said collar, said plug means moving out of said opening in said top of said cap to define a passage from the inside of said container around said plug means and thence through said opening in said top of said cap.

6. A container as claimed in claim 5, in which said cap includes a tubular portion which is a sealing fit within said third portion of said collar.

7. A container as claimed in claim 1, said container being moulded out of thermoplastic plastics material.

8. A container as claimed in claim 1, in which said collar is moulded out of thermoplastic plastics material.

9. A container as claimed in claim 1, in which said cap is moulded out of plastics material.

* * * * *